United States Patent [19]

Spinner

[11] 4,035,053

[45] July 12, 1977

[54] COAXIAL HF CONNECTOR

[76] Inventor: Georg Spinner, Am Eichberg 12, Feldkirchen, Westerham, Germany

[21] Appl. No.: 630,927

[22] Filed: Nov. 11, 1975

[30] Foreign Application Priority Data

Nov. 13, 1974 Germany ..... 2453841

[51] Int. Cl.[2] ..... H01R 13/06; H01R 13/12; H01R 17/06

[52] U.S. Cl. ..... 339/177 E; 339/252 P; 339/256 R

[58] Field of Search ..... 339/177 E, 177 R, 256 R, 339/252 P

[56] References Cited

U.S. PATENT DOCUMENTS

| | | | |
|---|---|---|---|
| 2,064,545 | 12/1936 | Kleinmann et al. | 339/252 P |
| 3,031,641 | 4/1962 | Camzi | 339/256 R |
| 3,086,190 | 4/1963 | Neidecker et al. | 339/177 R |
| 3,437,982 | 4/1969 | O'Keefe et al. | 339/177 R |
| 3,828,303 | 8/1974 | Sladek et al. | 339/177 R |

FOREIGN PATENT DOCUMENTS

| | | | |
|---|---|---|---|
| 37,432 | 12/1968 | Germany | 339/177 R |
| 1,929,846 | 12/1970 | Germany | 339/177 R |

*Primary Examiner*—Roy Lake
*Assistant Examiner*—Neil Abrams
*Attorney, Agent, or Firm*—Ostrolenk, Faber, Gerb & Soffen

[57] ABSTRACT

Coaxial HF connector comprising an inner conductor plug and/or an outer conductor plug socket at the respective front (facing in the same direction) ends of both the plug and the socket are rigid closed rings and both the plug and the socket rearwardly of the rigid rings is longitudinally slitted for enabling flexing, resilient contact with the cooperating plug and/or socket; appropriate cooperating conical shaping of the plug and/or socket slitted sections is provided, principally with the plug generally tapering narrower toward its rigid ring and the socket having a slightly wider tapering.

9 Claims, 4 Drawing Figures

COAXIAL HF CONNECTOR

The invention relates to a coaxial HF connector comprising an inner conductor plug contact socket and/or an outer conductor plug socket. To increase their spring action, the plug contact socket are provided with longitudinal slits. Such plug contact sockets are known for example from German utility models Nos. 7,211,401 and 7,211,719. By means of their slitting and shaping a defined annular contacting area is achieved at a point defined by an annular step and the step is exactly retained in reproducible manner even after repeated plugging operations. A requirement is however that none of the sectors formed by the slitting has for instance been bent. However, this danger of bending exists in particular in the case of the very finely made sectors of inner conductors of smal diameter. In practice, it is repeatedly found that particularly on the plugging together, the sensitive inner conductor sockets are bent if the plugging operation is not carried out extremely carefully. In such a case there is no longer a guarantee of reliable contacting via the defined annular area. This is particularly disadvantageous because this error is frequently not noticeable when the plugging operation is carried out.

The problem underlying the invention is therefore to provide a connector comprising such by contact sockets in such a manner that even when it is handled unskillfully during the plugging operation no damage or bending of individual sectors can occur.

According to the invention this problem is solved in that the front end of the socket is in the form of a closed ring behind which the slits begin. The closed ring, like the front ends of the sockets, does not contribute to the electrical contacting. The closed ring is drawn inwardly, if the socket is one which is introduced into a sleeve. If however the socket is a receptacle into which a plug is inserted the ring is extended outwardly.

In a further development of the invention, the sensitive contact sectors are protected outwardly or inwardly by a rigid sleeve which is so disposed that it does not obstruct the plugging operation.

Some examples of embodiments of the invention will be explained hereinafter with the aid of the drawings, wherein.

Figure 1:
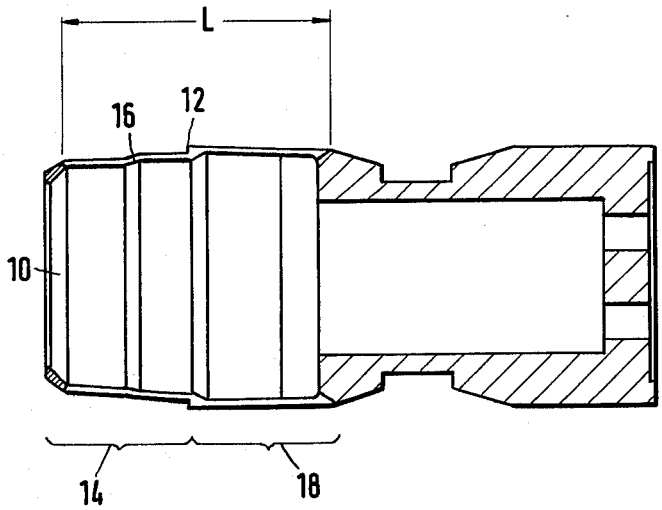
FIG. 1 is a sectional view of an inner conductor contact socket according to the invention.
Figure 2:
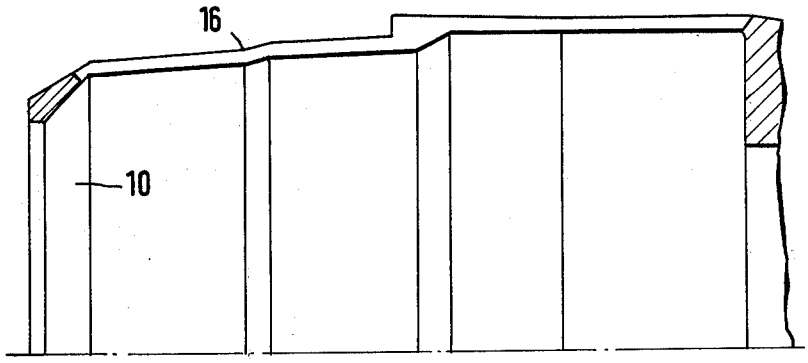
FIG. 2 shows to a larger scale a fragmental view of the inner conductor contact socket according to FIG. 1.

FIGS. 1 and 2 shows an inner conductor socket having longitudinal slits which run over the length L and which divide the socket into individual contact sectors. The front end comprises an inwardly drawn closed ring 10 so that a resilient basket is formed is radially compressed on insertion into a corresponding generally rigid contact sleeve. The plug sleeve or the inner conductor tube of the continuing conductor portion is introduced with the end annular area leading up to the turned-out step 12 and perfect contacting is established in the area of said step. The front portion 14 of the sockets disappearing in the tube are deformed radially inwardly on plugging together so that contact no longer takes place at the tube or the plug sleeve. To obtain the desired deformation in spite of the rigid supporting by the closed ring 10 a conical transition 16 is provided within the front portion 14.

The rear portion 18 of the contact sockets extends in the plugged-in condition cylindrically with the same outer diameter as the outer diameter of the continuing inner conductor portion behind the rear portion 18.

Figure 3:
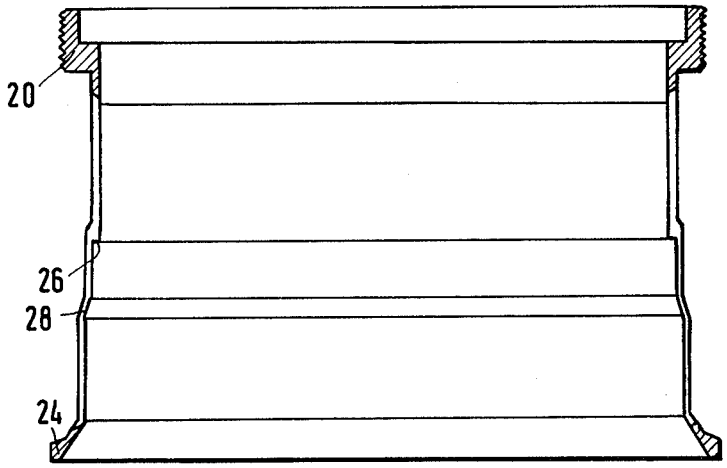
FIG. 3 is a sectional view of an outer conductor contact sleeve according to the invention.

The example of embodiment according to FIG. 3 shows an outer conductor contact sleeve, in particular for stirrup connectors. It may for example form the outer conductor plug sleeve in the connector according to FIG. 4. It comprises an externally helically threaded ring 20 adapted to be screwed into the stirrup connector outer conductor 22. The socket is longitudinally slit from the ring 20 up to a closed ring 24 at the front end of the plug sleeve which widens conically outwardly and serves as insertion guide. At 26 a step is provided in the region of which the contacting is effected. On insertion of a rigid outer conductor sleeve a definite resilient supporting is achieved. A conical widening 28 in the front portion of the plug sleeve achieves that in spite of the rigid ring 24 contacting takes place only in the region of the step 26 whilst the remaining portions of the sectors are spaced from the inserted outer conductor sleeve.

The protective rings 10 and 24 prevent individual sectors from being bent on being plugged in due to erroneous alignment, because the bent sectors then make the contacting unreliable. Erroneous plugging together with a connector constructed according to the invention is immediately apparent because the closed ring offers a high resistance to any lateral or axial forces which cannot be effected by an individual sector on erroneous assembly.

Figure 4:
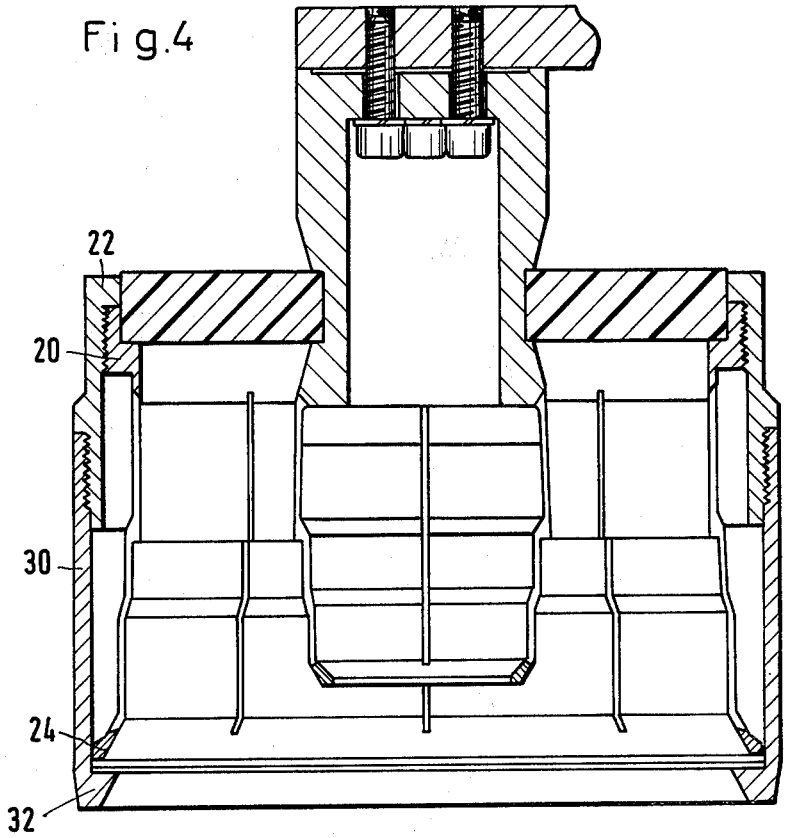
FIG. 4 is a fragmental sectional view of a stirrup connector comprising inner and outer conductor sockets constructed according to the invention and a protective tube for the latter.

To protect the outer conductor sleeve in the stirrup connector according to FIG. 4 still better in particular from lateral impacts said socket is surrounded by a rigid sleeve 30 which is screwed onto the outer conductor 22. In the front portion the sleeve 30 is provided with an inwardly drawn collar 32 which comes to bear axially in front of the ring 24 and provides further protection. To facilitate introduction said collar 32 is conically widened.

I claim:

1. An electric conductor plug contact socket for a coaxial HF connector, comprising:

said socket having a front end and also having a rear end; said socket rear end being connectable to a conductor;

said socket having a front end portion extending rearwardly from its said front end; said socket having a step engageable by a plug means with which said socket cooperates; said step being at and defining the rear end of said socket front end portion;

said socket having small thickness, and a generally tubular construction; said socket front end portion being longitudinally slitted, with a plurality of slits, thereby dividing said front end portion into a plurality of small thickness contact sectors;

a closed ring at said socket front end; said slits beginning rearwardly of said closed ring; said closed ring having a first diameter;

substantially the entire said front end portion having a gradual conically tapering shape moving away from said front end toward said step and gradually tapering in diameter generally away from said first diameter;

said socket being so shaped and arranged that upon engagement of said socket and a plug means, said front end portion sectors are deformable toward said first diameter of said front end ring;

a second step of steeper conicity than the rest of said front end portion and defined in said front end portion and extending across all said slits; said second step dividing said front end portion into two gradual conically tapering parts.

2. The electric conductor plug contact socket of claim 1, wherein said socket is an inner conductor plug contact socket and is shaped such that its said first diameter is smaller than the diameter of all of said front end portion.

3. The electric conductor plug contact socket of claim 2, wherein said closed ring is shaped to taper sharply inwardly toward said socket front end.

4. The electric conductor plug contact socket of claim 1, wherein said socket is an outer conductor plug contact socket and is shaped such that its said first diameter is greater than the diameter of all of said front end portion.

5. The electric conductor plug contact socket of claim 4, wherein said closed ring is shped to taper sharply outwardly toward said socket front end.

6. The electric conductor plug contact socket of claim 4, further comprising a protective sleeve; said socket being placed in and surrounded by said protective sleeve; said sleeve being shaped to provide clearance for motion of said contact sectors.

7. The electric conductor plug contact socket of claim 6, wherein said sleeve has a front end with a collar defined thereon; said collar being deformed inwardly; said collar bearing axially upon the front of said front ring of said socket.

8. The electric conductor plug contact socket of claim 7, wherein said collar widens conically moving forwardly of said sleeve.

9. In combination, the electric conductor plug contact socket of claim 4, and a second electric conductor plug contact socket disposed wholly inside the first mentioned said socket; said second socket is an inner conductor plug contact socket;

said second socket comprising a second front end directed in the same direction as said front end of said first socket and also having a second rear end connectable to a respective conductor;

said second socket having a second front end portion extending rearwardly from said second front end; said second socket having a third step engageable by a respective plug means with which said second socket cooperates; said third step being at and defining the rear end of said second socket second front end portion;

said second socket having small thickness and a generally tubular construction; said second socket front end portion being longitudinally slitted, with a plurality of seconds slits, thereby dividing said second front end portion into a plurality of small thickness second contact sectors;

a second closed ring at said second front end; said second slits beginning rearwardly of said second closed ring; said second closed ring having a second diameter;

substantially the entire said second front end portion having a gradual conically tapering wider shape moving away from said second front end toward said third step;

said second socket being so shaped and arranged that upon engagement of said second socket and a second plug means, said second front end portion second sectors are deformable inwardly toward said second diameter of said second front end ring;

a fourth step of steeper conicity than the rest of said second front end portion and defined in said second front end portion and extending across all said second slits; said fourth step dividing second front end portion into two gradual conically tapering parts.

* * * * *